US012704130B2

(12) United States Patent
Shiraki et al.

(10) Patent No.: US 12,704,130 B2
(45) Date of Patent: Aug. 11, 2026

(54) CENTRIFUGAL FAN

(71) Applicant: MABUCHI MOTOR CO., LTD., Chiba (JP)

(72) Inventors: Kenji Shiraki, Chiba (JP); Tetsushi Yoshikawa, Chiba (JP); Sakie Kawakami, Chiba (JP)

(73) Assignee: MABUCHI MOTOR CO., LTD., Chiba (JP)

( * ) Notice: Subject to any disclaimer, the term of this patent is extended or adjusted under 35 U.S.C. 154(b) by 0 days.

(21) Appl. No.: 19/131,218

(22) PCT Filed: Oct. 4, 2024

(86) PCT No.: PCT/JP2024/035607
§ 371 (c)(1),
(2) Date: May 20, 2025

(87) PCT Pub. No.: WO2025/191895
PCT Pub. Date: Sep. 18, 2025

(65) Prior Publication Data

US 2026/0098544 A1 Apr. 9, 2026

(51) Int. Cl.
*F04D 17/08* (2006.01)
*F04D 29/28* (2006.01)

(52) U.S. Cl.
CPC ..... *F04D 29/281* (2013.01); *F04D 17/08* (2013.01)

(58) Field of Classification Search
CPC ..... F04D 29/281; F04D 17/08
See application file for complete search history.

(56) References Cited

U.S. PATENT DOCUMENTS

2016/0084255 A1* 3/2016 Drechsel ..... F04D 13/0626 417/423.1
2017/0107994 A1* 4/2017 Kosaka ..... F04D 29/056
(Continued)

FOREIGN PATENT DOCUMENTS

CN 109958635 A 7/2019
CN 109958636 A 7/2019
(Continued)

OTHER PUBLICATIONS

International Search Report in PCT Application No. PCT/JP2024/035607 mailed Dec. 17, 2024, 5pp.
(Continued)

*Primary Examiner* — Nathaniel E Wiehe
*Assistant Examiner* — Theodore C Ribadeneyra
(74) *Attorney, Agent, or Firm* — HAUPTMAN HAM, LLP

(57) ABSTRACT

A centrifugal fan includes a first portion provided in a rotor, and a second portion provided in a fan unit and having a greater linear coefficient of expansion than that of the first portion. The first portion has a first top portion and a first tubular portion. The second portion has a second top portion and a second tubular portion. The second tubular portion has an inner tube surface facing an outer tube surface of the first tubular portion with a first clearance therebetween. The first top portion has a first flat surface, and the second top portion has a second flat surface facing the first flat surface. The first top portion or the second top portion is provided with a protrusion. The first flat surface and the second flat surface are bonded and fixed to each other with an adhesive provided in a second clearance formed by the protrusion.

14 Claims, 5 Drawing Sheets

(56) References Cited

U.S. PATENT DOCUMENTS

| | | | | |
|---|---|---|---|---|
| 2017/0284420 | A1* | 10/2017 | Nara | F04D 25/0693 |
| 2018/0355882 | A1* | 12/2018 | Ishii | F04D 17/16 |
| 2019/0195231 | A1 | 6/2019 | Ida et al. | |
| 2019/0195235 | A1 | 6/2019 | Ida et al. | |
| 2021/0095686 | A1* | 4/2021 | Shiraishi | F04D 29/281 |

FOREIGN PATENT DOCUMENTS

| | | | |
|---|---|---|---|
| JP | 2019116847 | A | 7/2019 |
| JP | 2019116848 | A | 7/2019 |
| JP | 2023174079 | A | 12/2023 |
| JP | 2024048818 | A | 4/2024 |
| WO | 2023228608 | A1 | 11/2023 |

OTHER PUBLICATIONS

Written Opinion in PCT Application No. PCT/JP2024/035607 mailed Dec. 17, 2024, 6pp.

* cited by examiner

CENTRIFUGAL FAN

CROSS-REFERENCE TO RELATED APPLICATIONS

This application is a national stage entry according to 35 U.S.C. 371 of PCT Application No. PCT/JP2024/035607 filed on Oct. 4, 2024.

TECHNICAL FIELD

The present invention relates to a centrifugal fan.

BACKGROUND ART

A centrifugal fan includes a fan unit having a plurality of blades and a motor unit serving as a drive source for the fan unit, and delivers fluid sucked from the vicinity of a rotation center to the radially outside of the fan unit as the fan unit rotates. Conventionally, there has been known a centrifugal fan in which a fan unit is fixed to a rotor of a motor unit such that the rotor and the fan unit are integrally rotated. For example, Patent Literature 1 discloses a centrifugal fan in which the outer peripheral surface of a metal rotor holder (rotor) provided in a motor (motor unit) and the inner peripheral surface of a blade support portion of a resin impeller (fan unit) are fixed with an adhesive.

CITATION LIST

Patent Literature

Patent Literature 1: JP-A-2019-116848

DISCLOSURE OF THE INVENTION

Problems to be Solved by the Invention

However, when the outer peripheral surface of the rotor holder and the inner peripheral surface of the blade support portion of the fan unit are bonded and fixed to each other as in Patent Literature 1, there is a possibility that the position of the center of gravity is misaligned due to thermal deformation depending on use environment of the centrifugal fan. The thermal deformation described here means that the fan unit of the centrifugal fan and a fixing member (rotor holder in Patent Literature 1) to which the fan unit is fixed change in dimension in accordance with a temperature or a temperature change around the centrifugal fan. The fan unit and the fixing member are often made of different materials, and for example, as in Patent Literature 1, the fan unit may be made of resin, and the fixing member may be made of metal. As described above, when the fan unit is formed of the material having a greater linear coefficient of expansion than that of the fixing member, the thermal deformation amount of the fan unit is greater than the thermal deformation amount of the fixing member, and thus, there is a possibility that the position of the center of gravity of the fan unit with respect to the fixing member is misaligned from the position before (at the beginning of) the thermal deformation. If the position of the center of gravity of the fan unit is misaligned, a fan balance may be adversely affected, and vibration and noise may be caused upon operation of the centrifugal fan.

The centrifugal fan of the present invention has been devised in view of such a problem, and an object thereof is to reduce misalignment of the position of the center of gravity due to thermal deformation. Note that objects of the present invention are not limited to this object, but also include another object of exerting operations and effects that can be derived from configurations presented in DESCRIPTION OF PREFERRED EMBODIMENTS described below, the operations and effects being unobtainable by the known technology.

Solutions to the Problems

The centrifugal fan according to the disclosure can be achieved as aspects (application examples) disclosed below, and solves at least some of the above-described problems.

The centrifugal fan according to the disclosure includes a first portion provided in a rotor that rotates integrally with a shaft, and a second portion provided in a fan unit having a plurality of blades and fixed to the rotor and having a greater linear coefficient of expansion than that of the first portion. The first portion includes a first top portion extending from a first hole through which the shaft is inserted toward the radially outside of the shaft and having a first flat surface facing a first axial direction in the axial direction of the shaft, and a first tubular portion having a tubular shape and extending from a radially outside end portion of the first top portion in a second axial direction opposite to the first axial direction. The second portion includes a second top portion located in the first axial direction with respect to the first top portion, extending to the radially outside from a second hole through which the shaft is inserted, and having a second flat surface facing the first flat surface, and a second tubular portion having a tubular shape, extending in the second axial direction from a radially outside end portion of the second top portion, and having an inner tube surface facing the outer tube surface of the first tubular portion with a first clearance therebetween. The first top portion is provided with a protrusion protruding in the first axial direction beyond the first flat surface and abutting on the second flat surface, or the second top portion is provided with a protrusion protruding in the second axial direction beyond the second flat surface and abutting on the first flat surface. The first flat surface and the second flat surface are bonded and fixed to each other with an adhesive provided in a second clearance formed by the protrusion.

Effects of the Invention

According to the centrifugal fan of the disclosure, it is possible to reduce the misalignment of the position of the center of gravity due to the thermal deformation.

DESCRIPTION OF PREFERRED EMBODIMENTS

A centrifugal fan as an embodiment will be described with reference to the drawings. The embodiment presented below is a mere exemplification. There is no intention to preclude various modifications and application of a technology, which are not explicitly stated in the embodiment below. The configurations of the embodiment can be modified and carried out in various manners within the scope that does not depart from the purport of the configurations.

1. Outline

Figure 1:
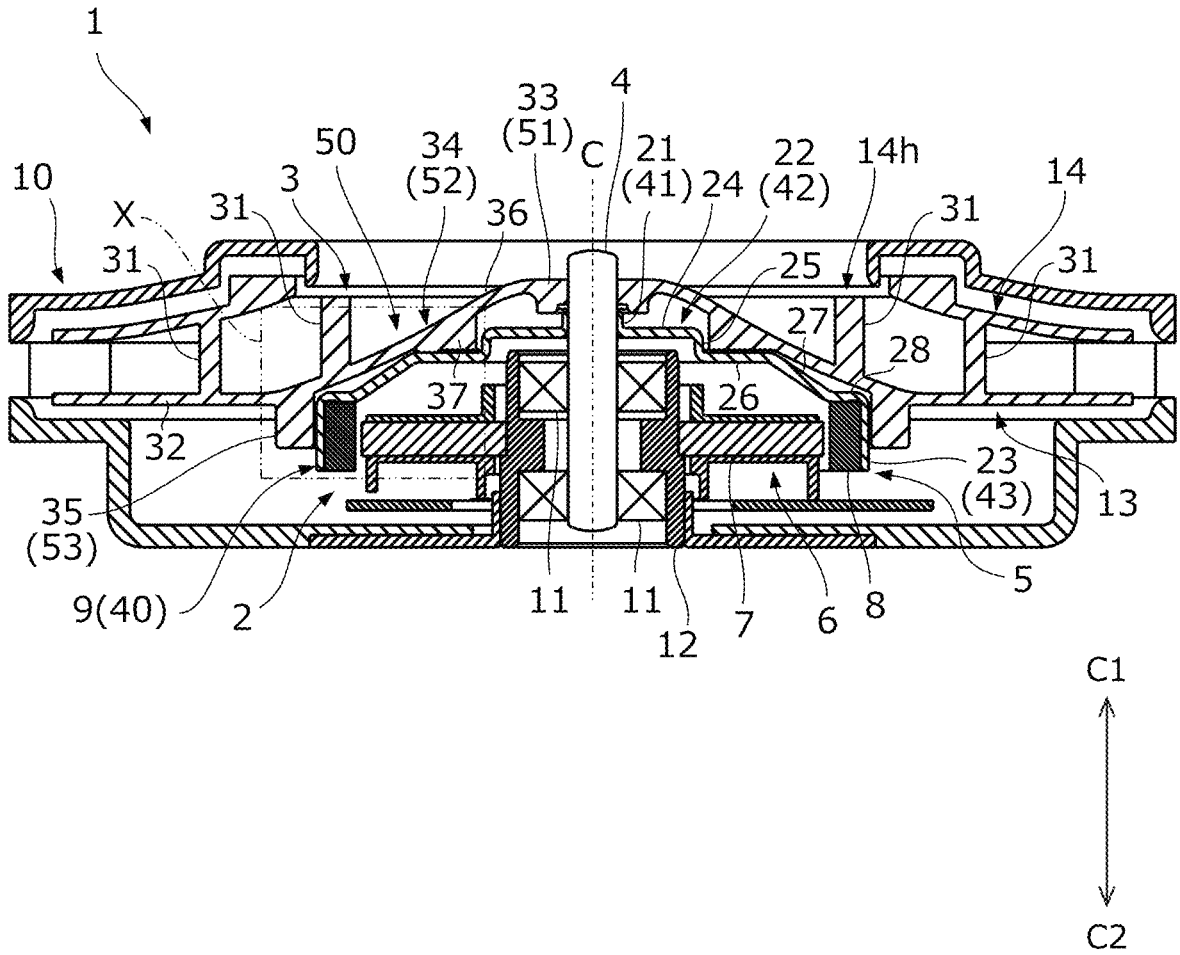
FIG. 1 is a sectional view of a centrifugal fan of an embodiment taken along an axial direction.
Figure 2:
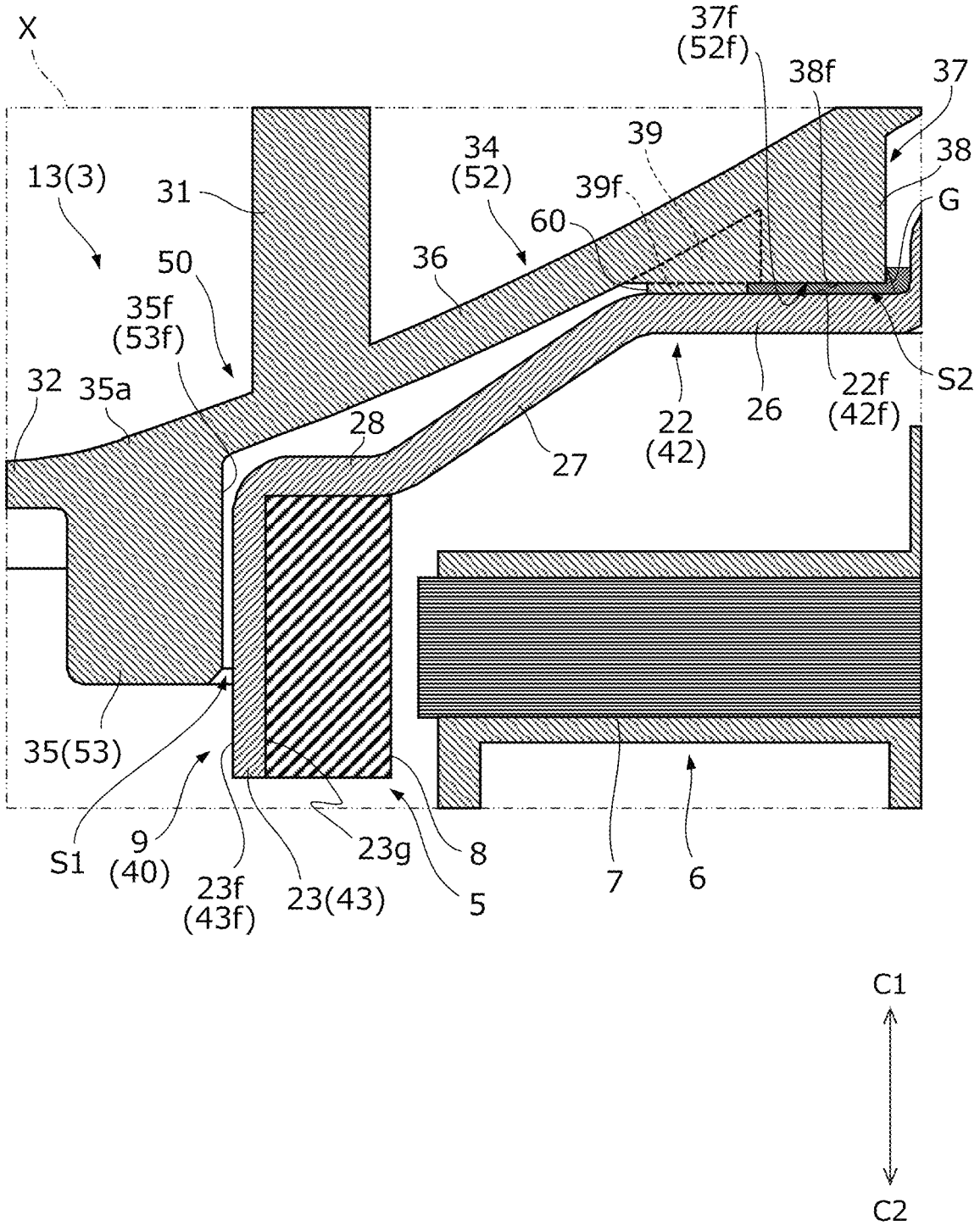
FIG. 2 is an enlarged view of a portion X in FIG. 1.

Hereinafter, the outline of a centrifugal fan 1 of the present embodiment will be described with reference to FIGS. 1 and 2, and then the configuration of the centrifugal fan 1 will be described in detail. FIG. 1 is a sectional view of the centrifugal fan 1 of the present embodiment taken along an axial direction, and FIG. 2 is an enlarged view of a portion X in FIG. 1.

As shown in FIG. 1, the centrifugal fan 1 includes a motor unit 2 as a drive source and a fan unit 3 to be driven by the motor unit 2. The motor unit 2 has a shaft 4, a rotor 5 that rotates integrally with the shaft 4, and a stator 6 disposed so as to face the rotor 5. The fan unit 3 is an impeller that rotates coaxially with the shaft 4 to deliver fluid sucked from the rotation center side outward (in a direction away from the rotation center), and has a plurality of blades 31. The fan unit 3 is attached to one side (first axial direction C1 side described later) in the axial direction of the shaft 4 with respect to the rotor 5 of the motor unit 2 and is fixed to the rotor 5, thereby rotating integrally with the shaft 4 and the rotor 5.

Hereinafter, the extending direction of the shaft 4 (the direction of the axis C of the shaft 4) will be referred to as an axial direction. In the axial direction, a direction in which the fan unit 3 is attached to the rotor 5 of the motor unit 2 will be referred to as a first axial direction C1, and a direction opposite to the first axial direction C1 will be referred to as a second axial direction C2. In addition, a direction orthogonal to the axial direction and away from the axis C of the shaft 4 will be referred to as radially outside, and a direction orthogonal to the axial direction and toward the axis C will be referred to as radially inside. In a case where the radially inside and outside are not distinguished from each other, these directions will be simply referred to as a radial direction. A direction orthogonal to the axial direction and around the axis C will be referred to as a circumferential direction.

The rotor 5 is provided with a first portion 40 on the first axial direction C1 side of the rotor 5. The fan unit 3 attached to the rotor 5 in the first axial direction C1 is provided with a cup-shaped second portion 50 opened in the second axial direction C2 on the second axial direction C2 side of the fan unit 3. The second portion 50 is made of a material having a greater linear coefficient of expansion than that of the first portion 40.

Note that in the present embodiment, as an example, a later-described rotor yoke 9 of the rotor 5 corresponds to the first portion 40. A configuration will be described, in which a portion of a bladed main plate 13 of the fan unit 3 on the radially inside of a main plate portion 32 (both these portions will be described later) corresponds to the second portion 50. Note that the first portion 40 is not necessarily the rotor yoke 9, and the second portion 50 is not necessarily part of the bladed main plate 13. In each drawing, in order to make it easy to understand a correspondence relationship between portions and surfaces (each element) of the first portion 40 and the second portion 50 and each configuration of a specific example, a reference numeral "40" indicating the first portion is provided in parentheses, and a reference numeral indicating each element of the first portion 40 and the second portion 50 is provided in parentheses.

The first portion 40 has a first top portion 42 extending toward the radially outside from a first hole 41 through which the shaft 4 is inserted, and a first tubular portion 43 having a tubular shape and extending in the second axial direction C2 from a radially outside end portion of the first top portion 42. The first hole 41 is a portion forming a through-hole through which the shaft 4 is inserted around the shaft 4. Note that the term "extending toward" as used herein is not limited to extending in a direction coincident with (parallel to) a reference direction (for example, the radial direction), and includes extending in a direction inclined with respect to the reference direction. Hereinafter, the same also applies to a case of describing "extending toward".

The second portion 50 has a second top portion 52 extending toward the radially outside from a second hole 51 through which the shaft 4 is inserted, and a second tubular portion 53 having a tubular shape and extending in the second axial direction C2 from a radially outside end portion of the second top portion 52 (position of a boundary between the second top portion 52 and the main plate portion 32 to be described later). The second hole 51 is a portion forming a through-hole through which the shaft 4 is inserted around the shaft 4. The second top portion 52 is provided on the first axial direction C1 side with respect to the first top portion 42. The second tubular portion 53 is provided outside the first tubular portion 43 in the radial direction, and is provided at the same position as that of the first tubular portion 43 in the axial direction (position overlapping with the first tubular portion 43 as viewed in the radial direction). That is, the second portion 50 is provided so as to cover the first portion 40 from the radially outside and the first axial direction C1 side.

As shown in FIG. 2, the first tubular portion 43 has an outer tube surface 43*f* facing the radially outside. The second tubular portion 53 has an inner tube surface 53*f* facing the radially inside. The inner tube surface 53*f* faces the outer tube surface 43*f* with a first clearance S1 therebetween. The first clearance S1 is a tubular space (gap) having a small dimension in the radial direction and formed between the inner tube surface 53*f* and the outer tube surface 43*f*.

The first top portion 42 has a first flat surface 42*f* facing the first axial direction C1. The second top portion 52 has a second flat surface 52*f* facing the second axial direction C2. The first flat surface 42*f* and the second flat surface 52*f* are flat surfaces facing each other. The first top portion 42 or the second top portion 52 is provided with a protrusion 60 for forming a second clearance S2 between the first flat surface 42*f* and the second flat surface 52*f*. The second clearance S2 includes a substantially circular ring-shaped space (gap) having a small dimension in the axial direction.

When provided on the first top portion 42, the protrusion 60 protrudes in the first axial direction C1 beyond the first flat surface 42*f*, and abuts on (contacts) the second flat surface 52*f*. On the other hand, when provided on the second top portion 52, the protrusion 60 protrudes in the second axial direction C2 beyond the second flat surface 52*f*, and abuts on (contacts) the first flat surface 42*f*. Since the protrusion 60 abuts on the first flat surface 42*f* or the second flat surface 52*f*, the first flat surface 42*f* and the second flat surface 52*f* do not contact each other, and the second clearance S2 having a width (dimension in the axial direction) corresponding to the protruding amount of the protrusion 60 is formed between the first flat surface 42*f* and the second flat surface 52*f*. An adhesive G is provided in the second clearance S2, and the fan unit 3 is bonded and fixed to the rotor 5 with the adhesive G.

For example, in a conventional centrifugal fan as disclosed in Patent Literature 1, an adhesive is interposed between a tubular portion (rotor holder of Patent Literature 1) of a rotor and a tubular portion (blade support portion of Patent Literature 1) of a fan unit fitted onto the tubular portion of the rotor. In contrast to such a configuration, in the centrifugal fan 1 of the present invention, the first clearance S1 is provided between the outer tube surface 43*f* of the first tubular portion 43 and the inner tube surface 53*f* of the second tubular portion 53. Further, the second clearance S2 is also provided between the first flat surface 42*f* of the first top portion 42 and the second flat surface 52*f* of the second top portion 52. The first flat surface 42*f* and the second flat surface 52*f* are bonded and fixed to each other by interposing the adhesive G in the second clearance S2. With these configurations, the centrifugal fan 1 reduces misalignment of the position of the center of gravity of the fan unit 3 due to thermal deformation of the second portion 50 having a greater linear coefficient of expansion than that of the first portion 40, as described later.

Here, the second portion 50 having a greater linear coefficient of expansion than that of the first portion 40 can be thermally deformed greater than the first portion 40 when exposed to environment where a temperature change around the second portion is drastic. The inventors of the present invention have found that the thermal deformation of the cup-shaped second portion 50 includes a tendency of the second tubular portion 53 being deformed so as to be reduced in diameter with the position of a boundary between the second top portion 52 and the second tubular portion 53 as a base point and a tendency of the second top portion 52 being deformed so as to float upward to the first axial direction C1 side.

In addition, it has been found that the latter one (i.e., the upward deformation of the second top portion 52) of these deformation tendencies is caused due to the misalignment of the position of the center of gravity of the fan unit 3. Furthermore, it has been found as follows. In the conventional centrifugal fan in which the adhesive is provided between the tubular portion of the rotor and the tubular portion of the fan unit, even if the tubular portion of the fan unit is about to be reduced in diameter due to the temperature change, such deformation is blocked by the adhesive. Since the deformation of the tubular portion is blocked, it is possible to replace such deformation with the upward deformation of a top portion of the fan unit (the amount of the upward deformation increases as compared with a case where the deformation of the tubular portion is not blocked).

Therefore, in the centrifugal fan 1 of the present invention, the first clearance S1 is provided between the first tubular portion 43 and the second tubular portion 53 such that even if the second tubular portion 53 is deformed so as to be reduced in diameter, such deformation is not blocked. Further, in order to leave the first clearance S1 as a space, a location to be bonded is changed, and the first top portion 42 and the second top portion 52 are bonded and fixed to each other.

As a result, the diameter-reducing deformation of the second tubular portion 53 is allowed, so that such deformation is not replaced with the upward deformation of the second top portion 52, and conversion of the force for diameter-reducing deformation of the second tubular portion 53 into the force for deforming the second top portion 52 is reduced. Therefore, the upward deformation of the second top portion 52 is reduced, and the misalignment of the position of the center of gravity of the fan unit 3 is reduced. In addition, since the protrusion 60 is provided, the second clearance S2 is formed between the first flat surface 42*f* and the second flat surface 52*f*. Since the adhesive G is provided in the second clearance S2, it is possible to obtain a higher bonding strength than that when the first flat surface 42*f* and the second flat surface 52*f* are bonded and fixed to each other with contacting each other. Therefore, the strength of fixing of the fan unit 3 to the rotor 5 is improved.

2. Detailed Configuration of Centrifugal Fan

Hereinafter, the configuration of the centrifugal fan 1 of the present embodiment will be described in detail with reference to FIGS. 1 to 5.

As shown in FIG. 1, the centrifugal fan 1 includes the motor unit 2 and the fan unit 3 as described above. The centrifugal fan 1 is configured such that, for example, the motor unit 2 and the fan unit 3 are incorporated in a housing 10 forming an outer shell of the centrifugal fan 1. The centrifugal fan 1 may be used as, for example, a ventilation fan attached to a seat of a vehicle.

As described above, the motor unit 2 has the shaft 4, the rotor 5, and the stator 6. The motor unit 2 of the present embodiment is an outer rotor type motor, and the stator 6 is disposed radially inside the rotor 5. The shaft 4 extends, for example, from the second axial direction C2 side with respect to the stator 6 to the first axial direction C1 side with respect to the fan unit 3. An end portion of the shaft 4 on the second axial direction C2 side and an intermediate portion of the shaft 4 in the axial direction may be rotatably supported by a bearing 11. The bearing 11 is held by a cylindrical bearing holder 12 fixed to the housing 10.

The stator 6 includes an annular stator core 7 in which a plurality of steel plates having the same shape is stacked on each other. The stator 6 may be provided with a coil (not shown) wound around the stator core 7 through an insulator. The stator core 7 is non-rotatably fixed to the housing 10 by being fitted and fixed onto the bearing holder 12 in a state in which the stacking direction of the steel plates coincides with the axial direction at the center thereof.

The rotor 5 includes a magnet 8 and the rotor yoke 9 disposed so as to face the stator core 7 in the radial direction. The magnet 8 is formed of, for example, a long rectangular rubber magnet, and is formed by connecting both ends of the rubber magnet in an annular shape having an inner diameter greater than the outer diameter of the stator core 7. The magnet 8 is fixed to the rotor yoke 9, and is disposed so as to face the radially outside of the stator core 7 with a gap therebetween.

The rotor yoke 9 is a member that fixes the magnet 8 such that the magnet 8 is not rotatable relative to the shaft 4 and reduces leakage of a magnetic line of the magnet 8, and is formed of, for example, a magnetic steel plate (metal). The rotor yoke 9 has, for example, a bottomed cylindrical shape (cup shape) opened in the second axial direction C2, and covers the stator 6 from the first axial direction C1 side. The rotor yoke 9 is provided with a first boss portion 21 fitted onto the shaft 4, a tubular fixing portion 23 located on the radially outside of the stator core 7, and a connection portion 22 connecting the first boss portion 21 and the fixing portion 23 to each other.

The first boss portion 21 is a portion forming a through-hole 21*h* (see FIG. 3) through which the shaft 4 is inserted, and has, for example, a cylindrical shape concentric with the axis C. The rotor yoke 9 is fixed to the shaft 4 so as not to rotate relative to the shaft 4 by inserting the shaft 4 into the through-hole 21*h* and press-fitting and fixing the first boss portion 21 to the shaft 4.

The fixing portion 23 is a portion for fixing the magnet 8, and is provided so as to surround the stator core 7 from the radially outside. The fixing portion 23 has, for example, a cylindrical shape concentric with the axis C, and extends in the axial direction. As shown in FIG. 2, the fixing portion 23 has an inner tube surface 23*g* having a diameter greater than the outer diameter of the stator core 7. The magnet 8 is fixed to the inner tube surface 23*g* of the fixing portion 23. Thus, the magnet 8 is fixed to the shaft 4 so as not to rotate relative to the shaft 4.

Figure 3:
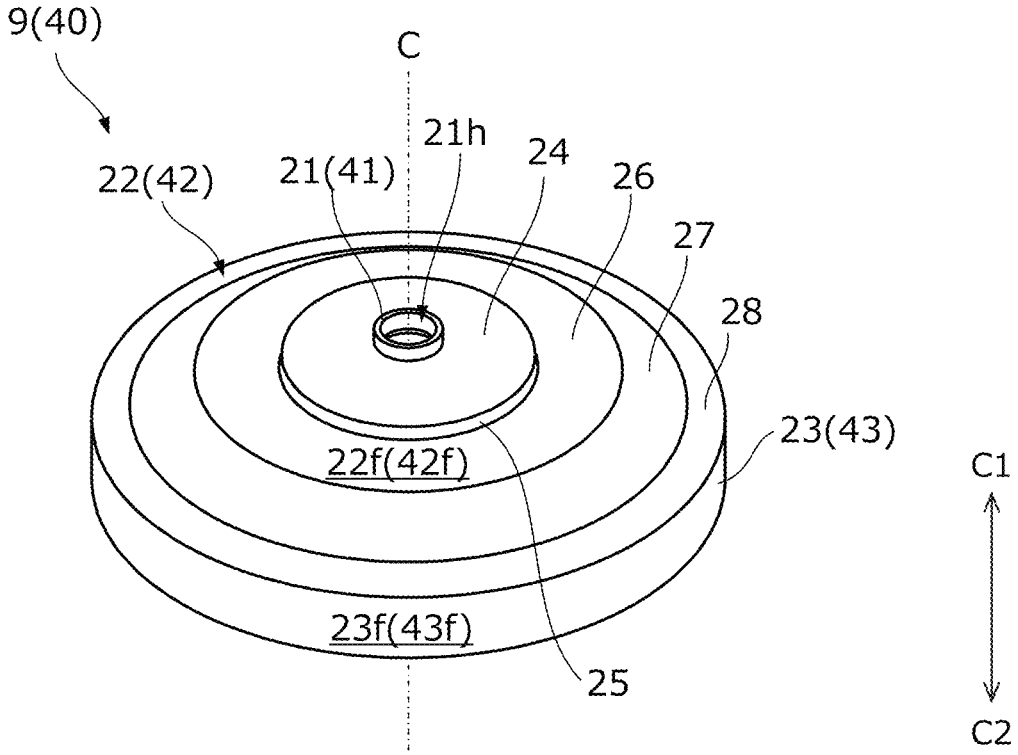
FIG. 3 is a perspective view of a rotor yoke provided in a rotor of a motor unit of the centrifugal fan of FIG. 1.

The connection portion 22 is a portion covering the magnet 8 and the stator 6 from the first axial direction C1 side. For example, as shown in FIGS. 1 and 3, the connection portion 22 may be configured by combining a flat portion, a curved portion, a stepped or tapered portion (parts) extending to the radially outside from an end portion of the first boss portion 21 on the second axial direction C2 side and connected to an end portion of the fixing portion 23 on the first axial direction C1 side. The connection portion 22 described here as an example includes an inner flat portion 24, a stepped portion 25, an intermediate flat portion 26, a slope portion 27, and an outer flat portion 28, and these portions 24 to 28 are continuously provided in this order from the radially inside to the radially outside. As shown in FIG. 3, each of the inner flat portion 24, the intermediate flat portion 26, the slope portion 27, and the outer flat portion 28 has a circular ring shape concentric with the axis C as viewed in the axial direction. The stepped portion 25 has a cylindrical shape concentric with the axis C, and extends in the axial direction.

As shown in FIG. 1, the inner flat portion 24 is connected to the second axial direction C2 side of the first boss portion 21, and extends to the radially outside. The stepped portion 25 is connected to the radially outside of the inner flat portion 24, and extends in the second axial direction C2. The intermediate flat portion 26 is connected to the second axial direction C2 side of the stepped portion 25, and extends to the radially outside. The slope portion 27 is connected to the radially outside of the intermediate flat portion 26, and extends to the radially outside and the second axial direction C2 side (obliquely). The outer flat portion 28 is connected to the radially outside of the slope portion 27, and extends to the radially outside. An end portion of the fixing portion 23 on the first axial direction C1 side is connected to a radially outside end portion of the outer flat portion 28. With these portions 24 to 28, the connection portion 22 extends, as a whole, to the radially outside and the second axial direction C2 side from the first boss portion 21. Note that the term "connection" used in the present specification means that two portions are connected to each other, and does not mean that two portions provided separately are connected (joined) to each other.

In the present embodiment, the rotor yoke 9 is provided as the first portion 40 described above. The first boss portion 21 corresponds to the above-described first hole 41, the connection portion 22 corresponds to the above-described first top portion 42, and the fixing portion 23 corresponds to the above-described first tubular portion 43. An outer tube surface 23*f* (see FIGS. 2 and 3) of the fixing portion 23 facing the radially outside corresponds to the above-described outer tube surface 43*f*. A surface (hereinafter, referred to as a "bonding surface 22*f*") of the intermediate flat portion 26 of the connection portion 22 facing the first axial direction C1 corresponds to the above-described first flat surface 42*f*.

Figure 4:
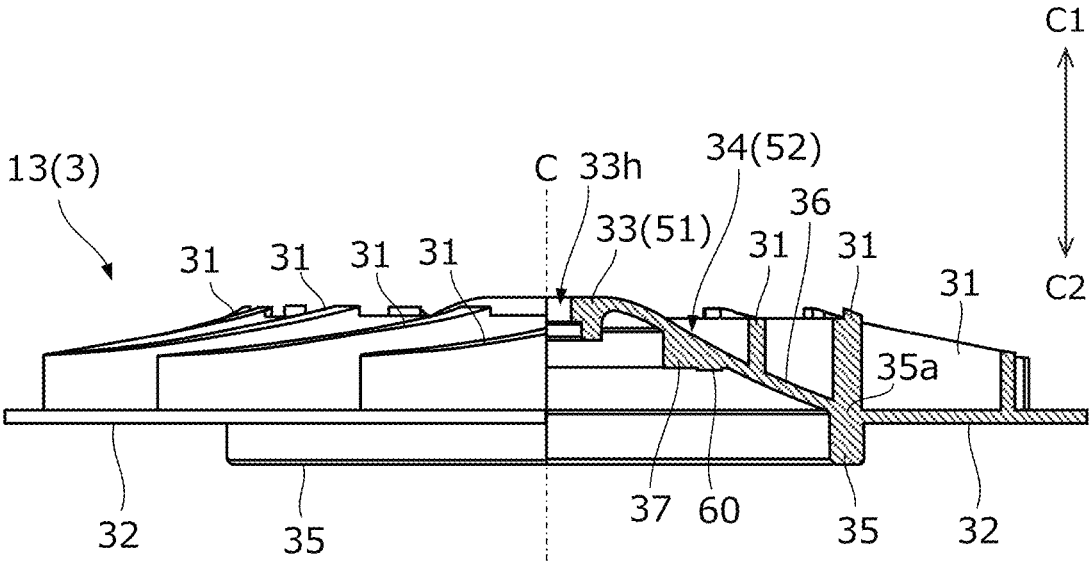
FIG. 4 is a half sectional view, which is taken along the axial direction, of a bladed main plate provided in a fan unit of the centrifugal fan of FIG. 1.

The fan unit 3 is an impeller that delivers fluid sucked from the radially inside to the radially outside, and includes a plurality of blades 31 standing in the axial direction as shown in FIG. 4. The plurality of blades 31 is arranged at equal intervals in the circumferential direction around the axis C. The fan unit 3 may be provided with the main plate portion 32 that supports end portions of the plurality of blades 31 on the second axial direction C2 side.

As shown in FIG. 1, the fan unit 3 may include the bladed main plate 13 in which the plurality of blades 31 and the main plate portion 32 are integrally molded, and a shroud 14. The fan unit 3 is configured, for example, by attaching and fixing the shroud 14 to the bladed main plate 13 on the first axial direction C1 side. The bladed main plate 13 and the shroud 14 are, for example, separately molded from resin having a greater linear coefficient of expansion than that of the rotor yoke 9 and then combined.

The shroud 14 is a plate member fixed to the end portions of the plurality of blades 31 on the first axial direction C1 side, and has a circular ring shape in which an air passage hole 14*h* for an air suction guiding path is formed on the radially inside. The shroud 14 is fixed to the bladed main plate 13 by, for example, ultrasonic welding.

Figure 5:
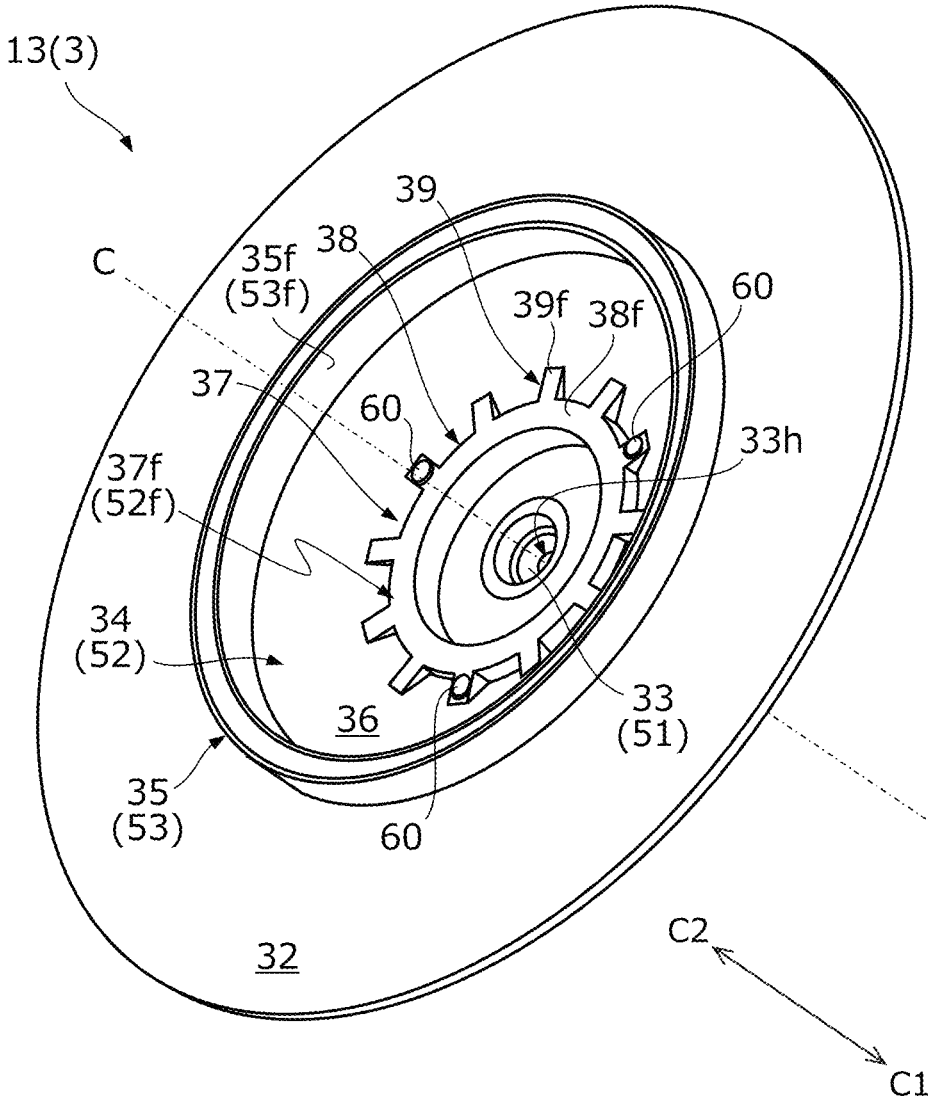
FIG. 5 is a perspective view of the bladed main plate of FIG. 4 as viewed in a second axial direction.

The bladed main plate 13 includes the blades 31 and the main plate portion 32 as described above. The main plate portion 32 of the present embodiment is provided radially outside the fixing portion 23 of the rotor yoke 9. For example, as shown in FIGS. 1, 4, and 5, the main plate portion 32 has a flat plate shape with a uniform dimension (thickness, plate thickness) in the axial direction, and has a circular ring shape concentric with the axis C as viewed in the axial direction.

In the present embodiment, a portion corresponding to the above-described second portion 50 is provided radially inside the main plate portion 32 of the bladed main plate 13. In the present embodiment, the protrusion 60 described above is provided on the bladed main plate 13. The bladed main plate 13 is provided with a second boss portion 33, a top portion 34, and a tubular portion 35 as the portion corresponding to the second portion 50.

The second boss portion 33 is a portion corresponding to the second hole 51 of the second portion 50 described above, is a portion forming a through-hole 33*h* (see FIGS. 4 and 5) through which the shaft 4 is inserted, and has, for example, a cylindrical shape concentric with the axis C. The inner diameter of the second boss portion 33 is set to be equal to the outer diameter of the shaft 4 or slightly greater than the outer diameter of the shaft 4, for example. Note that the second boss portion 33 may or may not be fixed to the shaft 4.

The top portion 34 is a portion corresponding to the second top portion 52 of the second portion 50 described above. As shown in FIG. 1, the top portion 34 extends to the radially outside from the second boss portion 33 and is connected to the radially inside of the main plate portion 32, thereby covering the rotor yoke 9 from the first axial direction C1 side.

The top portion 34 of the present embodiment is provided with a main portion 36 extending to the radially outside and the second axial direction C2 side (obliquely) in correspondence with the extending direction of the connection portion 22 of the rotor yoke 9 described above. The main portion 36 is a substantially plate-shaped portion forming a circular ring shape concentric with the axis C as viewed in the axial direction, and extends from the second boss portion 33 to the radially inside of the main plate portion 32. In other words, the main portion 36 extends obliquely with respect to the axial direction so as to form a mountain protruding toward the first axial direction C1 side as viewed in the radial direction. With such a main portion 36, the fluid sucked from the first axial direction C1 side is easily guided to the second axial direction C2 side and the radially outside along the extending direction of the main portion 36.

Note that as shown in FIGS. 1 and 4, the end portions of the plurality of blades 31 on the second axial direction C2 side may be connected not only to the main plate portion 32 but also to the main portion 36. That is, the main portion 36 may have the function of the main plate portion 32 (function of supporting the end portions of the plurality of blades 31 on the second axial direction C2 side) together with the main plate portion 32. The thickness of the plate-shaped main portion 36 is preferably equal to the thickness of the main plate portion 32.

As shown in FIG. 2, the top portion 34 may further be provided with a rib portion 37 protruding from the main portion 36 in the second axial direction C2 to reinforce the main portion 36. Here, an end surface 37*f* of the rib portion 37 on the second axial direction C2 side corresponds to the above-described second flat surface 52*f*. Therefore, the rib portion 37 is provided such that the end surface 37*f* thereof faces the bonding surface 22*f* of the rotor yoke 9. As shown in FIGS. 1 and 4, the rib portion 37 is preferably provided at a position apart from the radially outside end portion of the main portion 36 to the radially inside (i.e., position where the tubular portion 35 is provided) and at a position apart from the second boss portion 33 to the radially outside.

As shown in FIG. 5, the top portion 34 may be provided with a circular ring-shaped rib portion 38 and an auxiliary rib portion 39 as the rib portion 37. The circular ring-shaped rib portion 38 is a portion protruding from the main portion 36 in the second axial direction C2 so as to form a cylindrical shape concentric with the axis C, and has a circular ring shape concentric with the axis C as viewed from the second axial direction C2 side.

The auxiliary rib portion 39 is a portion protruding from the main portion 36 in the second axial direction C2 and extending to the radially outside from part of the circular ring-shaped rib portion 38, and has, for example, a rectangular shape as viewed from the second axial direction C2 side. In the present embodiment, as described above, since the main portion 36 extends to the radially outside and the second axial direction C2 side, the auxiliary rib portion 39 protruding from the main portion 36 has a substantially triangular prism shape with the circumferential direction as a height direction.

Note that as shown in the drawing, the auxiliary rib portion 39 may include a plurality of auxiliary rib portions 39. Here, 12 auxiliary rib portions 39 are provided. The 12 auxiliary rib portions 39 all have the same shape, are provided apart from each other at equal intervals in the circumferential direction, and radially extend to the radially outside of the circular ring-shaped rib portion 38. Note that in FIG. 5, only one of the 12 auxiliary rib portions 39 is denoted by a reference numeral.

As shown in FIGS. 2 and 5, the circular ring-shaped rib portion 38 and the auxiliary rib portion 39 both protrude to the same position in the axial direction. That is, an annular end surface 38*f* of the circular ring-shaped rib portion 38 on the second axial direction C2 side and a rectangular end surface 39*f* of the auxiliary rib portion 39 on the second axial direction C2 side form one continuous flat surface (flat surface orthogonal to the axial direction), and form the end surface 37*f* of the rib portion 37.

In the present embodiment, as shown in FIGS. 2 and 5, the protrusion 60 is provided so as to protrude in the second axial direction C2 from the rectangular end surface 39*f* of the auxiliary rib portion 39. The protruding amount of the protrusion 60 from the rectangular end surface 39*f* is preferably set to be equal to an optimum film thickness of the adhesive G. Here, the optimum film thickness means a film thickness when the bonding strength obtained by the adhesive G is a strength capable of withstanding a load assumed upon use as the centrifugal fan 1. For example, for the adhesive G satisfying the specifications of the centrifugal fan 1, a relationship between the film thickness and the bonding strength may be verified by experiment, simulation, or the like, and the optimum film thickness may be determined based on the verification result.

Here, as shown in FIG. 5, three protrusions 60 having the same shape are provided apart from each other at equal intervals in the circumferential direction. The three protrusions 60 are each provided on three of the 12 auxiliary rib portions 39. More specifically, each of the three protrusions 60 is provided on every third auxiliary rib portion 39 of the 12 auxiliary rib portions 39.

The three protrusions 60 are set to have the same protruding amount from the rectangular end surface 39*f*. Such three protrusions 60 abut on (contact) the bonding surface 22*f* of the rotor yoke 9, so that the end surface 37*f* of the rib portion 37 is disposed in parallel with the bonding surface 22*f*. Therefore, the width of the second clearance S2, which is formed between the bonding surface 22*f* and the end surface 37*f*, in the axial direction becomes uniform, and the balance of bonding of the fan unit 3 to the rotor 5 is improved.

The second clearance S2 is formed between each of the annular end surface 38*f* and the rectangular end surface 39*f* and the bonding surface 22*f*. Therefore, the second clearance S2 includes a circular ring-shaped space (gap) and a space (gap) radially extending to the radially outside from the circular ring-shaped space as viewed in the axial direction. The adhesive G is provided in these spaces. That is, the adhesive G is provided so as to extend around in the circumferential direction in the circular ring-shaped space, and is also provided so as to extend to the radially outside from the circular ring-shaped space.

Note that the width of the circular ring-shaped rib portion 38 in the radial direction and the width of the auxiliary rib portion 39 in the circumferential direction are preferably set to be equal to each other. The width of the circular ring-shaped rib portion 38 in the radial direction and the width of the auxiliary rib portion 39 in the circumferential direction are more preferably widths capable of ensuring a bonding area for obtaining a bonding strength satisfying the specifications of the centrifugal fan 1, and are preferably set to be slightly greater than the thicknesses of the main portion 36 and the main plate portion 32. As a result, when the bladed main plate 13 is molded, shape distortion caused by a difference in curing time due to a difference in resin amount is reduced.

The tubular portion 35 is a portion corresponding to the second tubular portion 53 of the second portion 50 described above. As shown in FIGS. 1 and 2, the tubular portion 35 extends in the second axial direction C2 from the radially outside end portion of the top portion 34 to the position overlapping with the fixing portion 23 of the rotor yoke 9 as viewed in the radial direction. For example, as shown in FIG. 5, the tubular portion 35 has a cylindrical shape in which each of an inner tube surface 35*f* facing the radially inside and an outer tube surface facing the radially outside has a uniform diameter in the axial direction, and is concentric with the axis C.

The inner tube surface 35*f* of the tubular portion 35 corresponds to the inner tube surface 53*f* of the second portion 50 described above. As shown in FIG. 2, the diameter of the inner tube surface 35*f* is set to a size capable of forming the first clearance S1 between the inner tube surface 35*f* and the outer tube surface 23*f* of the fixing portion 23. For example, the first clearance S1 is set to such a size that the tubular portion 35 does not come into contact with the fixing portion 23 even when the tubular portion 35 is deformed so as to be reduced in diameter. As a result, the blocking of the diameter-reducing deformation of the tubular portion 35 by the fixing portion 23 is reduced, and thus the deformation of the top portion 34 is reduced.

In the present embodiment, as shown in FIG. 2, a portion at the position of a boundary between the plate-shaped main portion 36 and the tubular portion 35 having a uniform diameter in the axial direction may have a relatively greater wall thickness than those of other portions of the bladed main plate 13. Note that the term "greater wall thickness" as used herein means that the wall (resin) of the fan unit 3 is thickened by joining each portion forming the fan unit 3. Hereinafter, this portion will be referred to as a "thick portion 35*a*".

In the present embodiment, as described above, the end portions of the plurality of blades 31 on the second axial direction C2 side are connected to the main portion 36, and the radially inside end portion of the main plate portion 32 is connected to the radially outside end portion of the main portion 36. Therefore, as shown in FIG. 4, in the thick portion 35*a*, the thickness may be further increased at a portion where base portions of the blades 31 in the second axial direction C2 and a radially inside base portion of the main plate portion 32 are gathered.

With such a thick portion 35*a*, the tendency of the thermal deformation of the top portion 34 and the tubular portion 35 provided as the second portion 50 is more easily observed in the fan unit 3. However, since the diameter-reducing deformation of the tubular portion 35 starting from the thick portion 35*a* is allowed by the first clearance S1, the deformation of the top portion 34 is reduced. Note that in the present embodiment, it is also said that the circular ring-shaped rib portion 38 and the auxiliary rib portion 39 described above are provided at positions apart from the tubular portion 35, i.e., positions apart from the thick portion 35*a*.

3. Features and Effects (1) In the centrifugal fan 1 described above, the first clearance S1 is formed between the outer tube surface 43*f* (outer tube surface 23*f*) of the first tubular portion 43 (fixing portion 23) and the inner tube surface 53*f* (inner tube surface 35*f*) of the second tubular portion 53 (tubular portion 35). As a result, even when the centrifugal fan 1 is used in the environment where the temperature change is great, the diameter-reducing deformation of the second tubular portion 53 due to the temperature change is allowed, so that the upward deformation of the second top portion 52 (top portion 34) due to the blocking of the diameter-reducing deformation of the second tubular portion 53 can be reduced. Therefore, the misalignment of the position of the center of gravity of the fan unit 3 can be reduced.

The bonding position between the first portion 40 provided in the rotor 5 and the second portion 50 provided in the fan unit 3 is changed to the position of the top portion 42, 52 instead of the position of the tubular portion 43, 53. As described above, the second top portion 52 bonded and fixed to the first portion 40 (rotor yoke 9) instead of the second tubular portion 53 is provided with the second flat surface 52*f* (end surface 37*f*) facing the first flat surface 42*f* (bonding surface 22*f*) and the protrusion 60 protruding in the first axial direction C1 beyond the second flat surface 52*f* and abutting on the first flat surface 42*f*. The second clearance S2 is formed between the first flat surface 42*f* and the second flat surface 52*f* by the protrusion 60. The first flat surface 42*f* and the second flat surface 52*f* are bonded and fixed with the adhesive G provided in the second clearance S2, whereby the bonding strength of these flat surfaces 42*f*, 52*f* is further enhanced. Therefore, according to the centrifugal fan 1 described above, it is possible to effectively reduce the misalignment of the position of the center of gravity due to the thermal deformation while ensuring the strength of the bonding of the fan unit 3 to the rotor 5.

(2) When the protruding amount of the protrusion 60 is set to the optimum film thickness of the adhesive G, the first flat surface 42*f* and the second flat surface 52*f* can be more firmly fixed to each other.

(3) The top portion 34 as the second top portion 52 is provided with the main portion 36 extending to the radially outside and the second axial direction C2 side from the second boss portion 33 as the second hole 51. As a result, the fan unit 3 can smoothly push out the fluid sucked from the first axial direction C1 side in the second axial direction C2 and toward the radially outside along the main portion 36. Therefore, the air blowing efficiency of the fan unit 3 can be improved. In addition, since it is possible to reduce swirling of the fluid on the radially inside of the fan unit 3, noise of the fan unit 3 is also reduced.

(4) The top portion 34 is provided with the rib portion 37 protruding from the main portion 36 in the second axial direction C2 to reinforce the main portion 36. Using the end surface 37*f* of the rib portion 37 as the second flat surface 52*f*, the top portion 34 as the second top portion 52 can be bonded and fixed to the connection portion 22 as the first top portion 42 without intentionally providing a portion forming the second flat surface 52*f* at the top portion 34. In addition, by adding the rib portion 37 to the top portion 34, the flowability of the resin at the time of molding can be improved, and the finishing accuracy of the fan unit 3, such as flatness and parallelism, can be improved.

(5) When the rib portion 37 having the end surface 37*f* bonded and fixed to the bonding surface 22*f* is provided at the position apart from the tubular portion 35 in the radial direction, it is possible to reduce the blocking of the diameter-reducing deformation of the tubular portion 35 by the rib portion 37. As a result, it is possible to reduce the replacement of the force of the diameter-reducing deformation of the tubular portion 35 with the upward deformation of the top portion 34, and thus, it is possible to effectively reduce the misalignment of the position of the center of gravity of the fan unit 3. In addition, when the rib portion 37 is provided at the position apart from the tubular portion 35, it is possible to reduce the gathering of the resin around the tubular portion 35, and therefore to reduce the diameter-reducing deformation of the tubular portion 35. The base portion of the tubular portion 35 on the main portion 36 side is the portion where the base portions of the blades 31 in the axial direction and the radially inside base portion of the main plate portion 32 are joined, and when the rib portion 37 is provided at the position apart from the tubular portion 35, the wall thickness of the thick portion 35*a* can be reduced, i.e., the diameter-reducing deformation of the tubular portion 35, the upward deformation of the top portion 34, and warpage deformation of the main plate portion 32 can be reduced. From this point, the misalignment of the position of the center of gravity of the fan unit 3 can be reduced.

(6) When the rib portion 37 is provided at the position apart from the second boss portion 33 in the radial direction, it is possible to reduce the protruding amount of the rib portion 37 from the main portion 36 extending to the radially outside the second axial direction C2 side. Therefore, the moldability of the bladed main plate 13 having the second boss portion 33, the top portion 34, and the tubular portion 35 as the second portion 50 can be improved. Further, when the circular ring-shaped rib portion 38 is provided at the position apart from the second boss portion 33, the area of the annular end surface 38*f* of the circular ring-shaped rib portion 38 is increased. Therefore, the bonding area can be increased, and the bonding strength can be improved.

(7) In the centrifugal fan 1 described above, the protrusion 60 protrudes from the end surface 37*f* of the rib portion 37. As a result, the moldability of the bladed main plate 13 can be improved. In particular, when the bladed main plate 13 is made of resin, if the rib portion 37 and the protrusion 60 are separately provided, a problem that a portion to be the protrusion 60 is not sufficiently filled with the resin may be caused at the time of molding the bladed main plate 13. However, such a problem can be reduced by the protrusion 60 protruding from the end surface 37*f* of the rib portion 37. Further, by the protrusion 60 protruding from the end surface 37*f* of the rib portion 37, it is possible to reduce an error in the protruding amount of the protrusion 60 from the end surface 37*f* of the rib portion 37. Therefore, the space (second clearance S2) in which an appropriate amount (film thickness) of the adhesive G is interposed can be ensured between the end surface 37*f* and the bonding surface 22*f*.

(8) In the centrifugal fan 1 described above, as the rib portion 37, the circular ring-shaped rib portion 38 and the auxiliary rib portion 39 extending to the radially outside from the circular ring-shaped rib portion 38 are provided. By providing the auxiliary rib portion 39 on the radially outside of the circular ring-shaped rib portion 38 instead of on the radially inside, the protruding amount of the auxiliary rib portion 39 from the main portion 36 can be reduced. When the bladed main plate 13 is made of resin, the shape distortion caused by the difference in curing time due to the difference in resin amount during molding can be reduced by reducing the protruding amount of the auxiliary rib portion 39.

In addition, in the centrifugal fan 1 described above, the protrusion 60 protrudes from the rectangular end surface 39*f* of the auxiliary rib portion 39. As a result, the adhesive G can be applied in the circular ring shape to the circular ring-shaped space (part of the second clearance S2) between the annular end surface 38*f* of the circular ring-shaped rib portion 38 and the bonding surface 22*f*. Therefore, the balance of the bonding of the fan unit 3 to the rotor 5 can be further improved.

(9) In the centrifugal fan 1 described above, the three protrusions 60 are provided apart from each other at equal intervals in the circumferential direction. Consequently, the end surface 37*f* can be planarized with respect to the bonding surface 22*f* (the end surface 37*f* can be located in parallel with the bonding surface 22*f*), and therefore, the width of the second clearance S2 in the axial direction can be made uniform. Therefore, uneven bonding with the adhesive G can be reduced, and therefore, the balance of the bonding of the fan unit 3 to the rotor 5 can be improved. Note that when three or more protrusions 60 are provided on the auxiliary rib portion 39 located radially outside the circular ring-shaped rib portion 38, the accuracy of the planarization of the end surface 37*f* can be further improved.

(10) When the bladed main plate 13 including the second boss portion 33, the top portion 34, and the tubular portion 35 as the second portion 50 is made of resin and the rotor yoke 9 as the first portion 40 is made of metal, if the protrusion 60 is provided on the bladed main plate 13 side, the bladed main plate 13 including the protrusion 60 can be easily molded using resin having a higher moldability than that of metal.

4. Others

The configuration of the above-described centrifugal fan 1 is an example, and is not limited to the above-described configuration.

For example, the motor unit 2 may be an inner rotor type motor. The first portion 40 provided in the rotor 5 only needs to include at least the first top portion 42 and the first tubular portion 43, and is not limited to the rotor yoke 9. The first portion 40 does not necessarily have the cup shape. The first portion 40 only needs to be made of at least the material having a smaller linear coefficient of expansion than that of the second portion 50, and is not necessarily made of metal.

The first top portion 42 only needs to have at least the first flat surface 42*f* extending to the radially outside from the first hole 41 and facing the first axial direction C1. That is, the first top portion 42 is not necessarily the surface portion extending to the radially outside and the second axial direction C2 side as in the connection portion 22 described above. Further, the first top portion 42 does not necessarily include the plurality of portions 24 to 28 different in the extending direction as in the connection portion 22 described above. The first tubular portion 43 only needs to extend at least in the second axial direction C2 from the radially outside end portion of the first top portion 42, and does not necessarily surround the stator core 7 from the radially outside as in the fixing portion 23 described above.

The fan unit 3 only needs to have at least the plurality of blades 31. The shroud 14 may be omitted, and the blades 31 and the main plate portion 32 are not necessarily integrally molded as the bladed main plate 13. The second portion 50 provided in the fan unit 3 only needs to be the portion including at least the second top portion 52 and the second tubular portion 53, and may be a portion (component) provided separately from the bladed main plate 13. The second portion 50 only needs to be made of at least the material having a greater linear coefficient of expansion than that of the first portion 40, and is not necessarily made of resin. Both the first portion 40 and the second portion 50 may be made of resin or metal as long as these portions satisfy the relationship of the linear coefficient of expansion.

The second top portion 52 only needs to be at least the portion having the second flat surface 52*f* extending to the radially outside from the second hole 51 and facing the first flat surface 42*f*, and may be a portion simply extending perpendicularly to the axial direction from the second hole 51 and forming the second flat surface 52*f* facing the first flat surface 42*f* without including the main portion 36 and the rib portion 37 described above. The configuration of the rib portion 37 is an example, and for example, either the circular ring-shaped rib portion 38 or the auxiliary rib portion 39 may be omitted.

The first tubular portion 43 only needs to have at least the tubular shape having the outer tube surface 43*f* facing the radially outside, and the second tubular portion 53 only needs to have at least the tubular shape having the inner tube surface 53*f* facing the outer tube surface 43*f* with the first clearance S1 therebetween. The first tubular portion 43 and the second tubular portion 53 do not necessarily have the cylindrical shape, and may have, for example, a tubular shape having a polygonal outer shape as viewed in the axial direction.

In the centrifugal fan 1 described above, the protrusion 60 protrudes in the second axial direction C2 from the rectangular end surface 39*f* of the auxiliary rib portion 39, but may protrude from the annular end surface 38*f* of the circular ring-shaped rib portion 38. The protrusion 60 does not necessarily protrude from the end surface 37*f*. The protrusion 60 may be, for example, a portion protruding in the second axial direction C2 from the main portion 36 separately from the rib portion 37. The protrusion 60 may be provided on the first top portion 42 of the rotor 5.

DESCRIPTION OF REFERENCE SIGNS

1 Centrifugal fan
3 Fan unit
4 Shaft
5 Rotor
21 First boss portion (first hole)
22 Connection portion (first top portion)
22*f* Bonding surface (first flat surface)
23 Fixing portion (first tubular portion)
23*f* Outer tube surface
31 Blade
33 Second boss portion (second hole)
34 Top portion (second top portion)
35 Tubular portion (second tubular portion)
35*f* Inner tube surface
36 Main portion
37 Rib portion
37*f* End surface (second flat surface)
38 Circular ring-shaped rib portion
38*f* Annular end surface (second flat surface)
39 Auxiliary rib portion
39*f* Rectangular end surface (second flat surface)
40 First portion
41 First hole
42 First top portion
42*f* First flat surface
43 First tubular portion
43*f* Outer tube surface
50 Second portion
51 Second hole
52 Second top portion
52*f* Second flat surface
53 Second tubular portion
53*f* Inner tube surface
60 Protrusion
C1 First axial direction
C2 Second axial direction
G Adhesive
S1 First clearance
S2 Second clearance

The invention claimed is:

1. A centrifugal fan comprising:

a first portion provided in a rotor that rotates integrally with a shaft; and a second portion provided in a fan unit having a plurality of blades and fixed to the rotor and having a greater linear coefficient of expansion than that of the first portion, wherein the first portion includes a first top portion extending from a first hole through which the shaft is inserted toward a radially outside of the shaft and having a first flat surface facing a first axial direction in an axial direction of the shaft, and a first tubular portion having a tubular shape and extending from a radially outside end portion of the first top portion in a second axial direction opposite to the first axial direction, the second portion includes a second top portion located in the first axial direction with respect to the first top portion, extending to the radially outside from a second hole through which the shaft is inserted, and having a second flat surface facing the first flat surface, and a second tubular portion having a tubular shape, extending in the second axial direction from a radially outside end portion of the second top portion, and having an inner tube surface facing an outer tube surface of the first tubular portion with a first clearance therebetween, the second top portion is provided with a protrusion protruding from the second flat surface in the second axial direction beyond the second flat surface and abutting on the first flat surface, the second top portion has a main portion extending to the radially outside and a second axial direction side from the second hole, the second top portion further includes a rib portion protruding from the main portion in the second axial direction to reinforce the main portion, an end surface of the rib portion on the second axial direction side forming the second flat surface, the rib portion includes a circular ring-shaped rib portion protruding from the main portion in the second axial direction and having a circular ring shape as viewed from the second axial direction side, and an auxiliary rib portion protruding from the main portion in the second axial direction and extending to the radially outside from the circular ring-shaped rib portion, the protrusion protrudes from an end surface of the auxiliary rib portion on the second axial direction side, and the first flat surface and the second flat surface are bonded and fixed to each other with an adhesive provided in a second clearance formed by the protrusion.

2. The centrifugal fan according to claim 1, wherein a protruding amount of the protrusion from the second flat surface is set to an optimum film thickness of the adhesive.

3. The centrifugal fan according to claim 1, wherein the circular ring-shaped rib portion and the auxiliary rib portion are provided at a position apart from the second tubular portion in a radial direction.

4. The centrifugal fan according to claim 1, wherein the circular ring-shaped rib portion and the auxiliary rib portion are provided at a position apart from the second hole in the radial direction.

5. The centrifugal fan according to claim 1, wherein the first portion is made of metal, the second portion is made of resin, and the protrusion is provided on the second top portion.

6. A centrifugal fan comprising:

a first portion provided in a rotor that rotates integrally with a shaft; and a second portion provided in a fan unit having a plurality of blades and fixed to the rotor and having a greater linear coefficient of expansion than that of the first portion, wherein the first portion includes a first top portion extending from a first hole through which the shaft is inserted toward a radially outside of the shaft and having a first flat surface facing a first axial direction in an axial direction of the shaft, and a first tubular portion having a tubular shape and extending from a radially outside end portion of the first top portion in a second axial direction opposite to the first axial direction, the second portion includes a second top portion located in the first axial direction with respect to the first top portion, extending to the radially outside from a second hole through which the shaft is inserted, and having a second flat surface facing the first flat surface, and a second tubular portion having a tubular shape, extending in the second axial direction from a radially outside end portion of the second top portion, and having an inner tube surface facing an outer tube surface of the first tubular portion with a first clearance therebetween, the first top portion is provided with a protrusion protruding in the first axial direction beyond the first flat surface and abutting on the second flat surface, or the second top portion is provided with a protrusion protruding in the second axial direction beyond the second flat surface and abutting on the first flat surface, the protrusion of the first top portion or the second top portion includes at least three protrusions, the at least three protrusions are provided apart from each other at an equal interval in a circumferential direction of the shaft, and the first flat surface and the second flat surface are bonded and fixed to each other with an adhesive provided in a second clearance formed by the protrusion.

7. The centrifugal fan according to claim 6, wherein a protruding amount of the protrusion from the first flat surface or the second flat surface is set to an optimum film thickness of the adhesive.

8. The centrifugal fan according to claim 6, wherein the second top portion has a main portion extending to the radially outside and a second axial direction side from the second hole.

9. The centrifugal fan according to claim 8, wherein the second top portion further includes a rib portion protruding from the main portion in the second axial direction to reinforce the main portion, and an end surface of the rib portion on the second axial direction side forms the second flat surface.

10. The centrifugal fan according to claim 9, wherein the protrusion protrudes from the second flat surface of the second top portion.

11. The centrifugal fan according to claim 10, wherein the rib portion includes a circular ring-shaped rib portion protruding from the main portion in the second axial direction and having a circular ring shape as viewed from the second axial direction side, and an auxiliary rib portion protruding from the main portion in the second axial direction and extending to the radially outside from the circular ring-shaped rib portion, and the protrusion protrudes from an end surface of the auxiliary rib portion on the second axial direction side.

12. The centrifugal fan according to claim 9, wherein the rib portion is provided at a position apart from the second tubular portion in a radial direction.

13. The centrifugal fan according to claim 12, wherein the rib portion is provided at a position apart from the second hole in the radial direction.

14. The centrifugal fan according to claim 6, wherein the first portion is made of metal, the second portion is made of resin, and the protrusion is provided on the second top portion.

* * * * *